US008109059B2

(12) United States Patent
Proot

(10) Patent No.: US 8,109,059 B2
(45) Date of Patent: Feb. 7, 2012

(54) MULTIFUNCTION FINISHING SET FOR A FLOOR COVERING INCLUDING A MODULAR PROFILE

(75) Inventor: Bernard Proot, Marcq en Baroeul (FR)

(73) Assignees: Findes, Zandvoorde (BE); Goodwin International, Tournai (BE)

( * ) Notice: Subject to any disclaimer, the term of this patent is extended or adjusted under 35 U.S.C. 154(b) by 0 days.

(21) Appl. No.: 12/226,102

(22) PCT Filed: Apr. 10, 2007

(86) PCT No.: PCT/FR2007/000596

§ 371 (c)(1),
(2), (4) Date: Dec. 3, 2008

(87) PCT Pub. No.: WO2007/116144

PCT Pub. Date: Oct. 18, 2007

(65) Prior Publication Data

US 2009/0188199 A1 Jul. 30, 2009

(30) Foreign Application Priority Data

Apr. 10, 2006 (FR) ..... 06 03144

(51) Int. Cl.
*E04C 3/00* (2006.01)

(52) U.S. Cl. ..... 52/468; 52/464; 52/461; 52/716.1; 52/312; 52/98

(58) Field of Classification Search ..... 52/98, 100, 52/465, 468, 464, 716.1, 717.03, 717.05, 52/204.597, 461, 459, 470, 471, 469, 716.8, 52/312; D25/135, 136, 164; 428/116; 144/359, 144/360, 368, 371, 2.1, 3.1, 136.14; 296/93, 146.15

See application file for complete search history.

(56) References Cited

U.S. PATENT DOCUMENTS

| | | | | |
|---|---|---|---|---|
| 2,776,688 | A * | 1/1957 | Clark | 144/375 |
| 2,796,624 | A * | 6/1957 | Speer | 16/16 |
| 3,411,977 | A * | 11/1968 | Slater, Jr. | 428/33 |
| 4,893,449 | A * | 1/1990 | Kemper | 52/464 |
| 5,581,967 | A * | 12/1996 | Glatz | 52/465 |
| 5,706,623 | A * | 1/1998 | Brown | 52/718.04 |
| 6,230,385 | B1 * | 5/2001 | Nelson | 29/450 |

(Continued)

FOREIGN PATENT DOCUMENTS

DE 20 2005 020345 U1 2/2006

(Continued)

OTHER PUBLICATIONS

Quick-Step Incizo; http://www.quick-step.com/others/oth/en/installation_instructions.aspx.*

(Continued)

*Primary Examiner* — Robert Canfield
*Assistant Examiner* — Babajide Demuren
(74) *Attorney, Agent, or Firm* — Harness, Dickey & Pierce, P.L.C.

(57) ABSTRACT

The multifunctional finishing set for a floor covering includes: a modular profile with at least one groove arranged therein for separation of the profile into two distinct modules, a decorative film which is applied to the profile and covers the separation groove and a fixed reinforcement means housed in the separation groove which permits a reinforcement of the modular profile in the region of the separation groove.

21 Claims, 5 Drawing Sheets

U.S. PATENT DOCUMENTS

| | | | | |
|---|---|---|---|---|
| 6,345,480 | B1 * | 2/2002 | Kemper et al. | 52/395 |
| 6,647,680 | B2 * | 11/2003 | Daly et al. | 52/287.1 |
| D542,939 | S * | 5/2007 | Neuhofer, Jr. | D25/136 |
| D542,940 | S * | 5/2007 | Neuhofer, Jr. | D25/136 |
| D542,941 | S * | 5/2007 | Neuhofer, Jr. | D25/136 |
| D543,287 | S * | 5/2007 | Neuhofer, Jr. | D25/136 |
| 2003/0118812 | A1 * | 6/2003 | Kornfalt et al. | 428/331 |
| 2003/0154678 | A1 * | 8/2003 | Stanchfield | 52/468 |
| 2003/0159389 | A1 * | 8/2003 | Kornfalt et al. | 52/396.04 |
| 2005/0229517 | A1 * | 10/2005 | Gomez Insa | 52/393 |
| 2006/0150565 | A1 * | 7/2006 | Schacht et al. | 52/716.1 |
| 2007/0056239 | A1 * | 3/2007 | Schacht et al. | 52/582.1 |
| 2007/0182203 | A1 * | 8/2007 | Kellinghaus | 296/146.9 |
| 2007/0283654 | A1 * | 12/2007 | Stanchfield et al. | 52/465 |
| 2008/0034700 | A1 * | 2/2008 | Stanchfield et al. | 52/582.1 |

FOREIGN PATENT DOCUMENTS

| | | | |
|---|---|---|---|
| EP | 0 862 976 | A1 | 9/1998 |
| WO | WO-01/20101 | A | 3/2001 |
| WO | WO-2005/083195 | A | 9/2005 |
| WO | WO-2005/083196 | A | 9/2005 |

OTHER PUBLICATIONS http://www.maderascastellar.net/accesorios-quickstep.html.*

* cited by examiner

MULTIFUNCTION FINISHING SET FOR A FLOOR COVERING INCLUDING A MODULAR PROFILE

CROSS-REFERENCE TO RELATED APPLICATIONS

This application is a National Stage of International application No. PCT/FR2007/000596, filed Apr. 10, 2007. This application claims the benefit of FR06/03144, filed Apr. 10, 2006. The disclosures of the above applications are incorporated herein by reference.

FIELD OF THE INVENTION

The present invention relates to a finishing set for a floor covering, which includes a modular finishing profile covered by a decorative film and separable into at least two modules so that it can be used in at least two different finishing functions.

PRIOR ART

In the context of the laying of floating or glued floor coverings out of wood or the like for covering home floors, finishing profiles must be used. Because of this, these operations require the use of different types of finishing profiles out of wood or the like covered by a decorative film to realise the finishing, either between the floating or glued floor coverings or at the edges of the floating or glued floor coverings.

To date, finishing sets that are modular and multifunctional have already been suggested. German utility model DE-U-20 2005 020345, for instance, suggests multifunction finishing sets for a floor covering, including different modules that are covered by a decorative film and that are separable, after cutting of the decorative film, so that the finishing set can be configured to be used in different finishing functions, and in particular a function of a junction between two floor coverings, or an end fastening function or a level adjustment function between a floor covering and the floor or another floor covering of a different thickness.

More particularly, in an embodiment described in particular in German utility model DE-U-20 2005 020345 (FIG. 44), the finishing set includes a single modular finishing profile, which includes two separation grooves and which can be separated into three distinct modules.

A disadvantage of this embodiment of a single modular finishing profile lies in the fact that to create the separation grooves of the module, the manufacturer is confronted with two contradictory use constraints. The separation groove must allow a sufficient mechanical weakening of the profile to facilitate the separation of the profile into distinct modules during its implementation ($1^{st}$ constraint). Conversely, the mechanical rigidity of the two modules separated by a groove must be sufficient to ensure there is no weakening of one module in relation to the other when the profile is used in a finishing function where the two modules are not separated (e.g. end fastening function or level adjustment function between a floor covering and the floor or another floor covering of a different thickness). In a disadvantageous manner, the manufacturer is obliged to make a compromise between these two constraints, at the risk for instance of either creating a groove that enables a mechanical rigidity to be obtained that is sufficient but not sufficiently deep and makes the operation of separating the modules difficult, or on the contrary of creating a groove that is too deep, which facilitates the operation of separating the modules but to the detriment of the mechanical solidity.

OBJECT OF THE INVENTION

The invention has as its main object the suggestion of a new multifunction finishing set, which includes a modular finishing profile that can be separated into at least two modules so as to be able to be configured in at least two different finishing functions, and which mitigates the above-cited disadvantage in that the finishing profile can easily be separated into several modules, while being very solid in mechanical terms.

SUMMARY OF THE INVENTION

The invention thus has as its object a finishing set with at least two different applications and including a modular profile in which is created at least one groove for separating the profile into two distinct modules, and a decorative film, which is applied to the profile and which covers the separation groove.

In a characteristic manner according to the invention, said finishing set includes a removable reinforcement means, which is housed in the groove and which allows a reinforcement of the modular profile at the level of the separation groove.

Thus, thanks to the implementation of this supplementary and removable reinforcement means, the separation groove can be adapted to optimally facilitate the operation of separating the finishing profile modules, without being detrimental to the mechanical solidity of the profile, which is mechanically reinforced by the reinforcement means. In addition, because the reinforcement means is housed in the separation groove and covered by the decorative film, it is not visible and is not detrimental to the outward appearance of the finishing set.

More particularly, but optionally according to the invention, the finishing set includes the following additional and optional technical characteristics, taken in isolation or in combination:

- Finishing set includes two separation grooves; the decorative film that is applied to the modular profile covers the two separation grooves, and the finishing set includes a removable reinforcement means housed in each separation groove;
- the modular profile 1 can be separated into at least two distinct modules, one module (A) of which is adapted to fulfil a function of a junction (F1) between two floor coverings;
- the modular profile, prior to separation into several modules, is adapted to fulfil a function (F2) of end fastening or a function (F3) of level adjustment between a floor covering and the floor or another floor covering of a different thickness;
- the modular profile can be separated into at least three modules; a first module (A), once separated from the other modules, is adapted to fulfil a function of a junction (F1) between two floor coverings; said first module (A) and a second module (B) integral with the first module (A) are adapted to fulfil a function (F2) of end fastening between a floor covering and the floor or another floor covering of a different thickness; said first module (A) and a third module (B) integral with the first module (A) are adapted to fulfil a function (F3) of level adjustment between a floor covering and the floor or another floor covering of a different thickness;
- the modular profile can be separated into at least two modules, including a T-shaped module (A);

the modular profile 1 can be separated into at least three modules: a central T-shaped module (A), and two lateral modules (B), (C) on either side of the foot of the central T-shaped module (A);

the separation groove is adapted so as to make the modular profile manually divisible into two distinct modules, after the cutting of the decorative film along the separation groove;

each reinforcement means includes a longitudinal ridge (at the level of its external surface facing the decorative film) and is in contact with the film by means of this ridge, in order to limit the contact surface of said means with the film and to arrange a longitudinal space in the separation groove for the cutting of the film;

each reinforcement means displays a geometry complementary to the geometry of the separation groove that serves as its housing, and is positioned in the separation groove such that it is in contact with the two lateral walls and the base of the separation groove;

a reinforcement means displays a transversal section of a trapezoid shape;

each reinforcement means is made up of a thin linear wedge.

The invention also has as its object the use of the above multifunction finishing set to fulfil a function of a junction (F1) between two floor coverings (P), or a function of end fastening (F2 or F'2) or a function of level adjustment (F3) between a floor covering and the floor or another floor covering of a different thickness.

BRIEF DESCRIPTION OF DRAWINGS

Other characteristic features and advantages of the invention will appear more clearly upon reading the detailed description hereinafter of a finishing set according to the invention with three finishing functions, the detailed description of which is given by way of a non-limiting and non-exhaustive example of the invention, and with reference to the attached drawings, in which.

DETAILED DESCRIPTION

Figure 5:
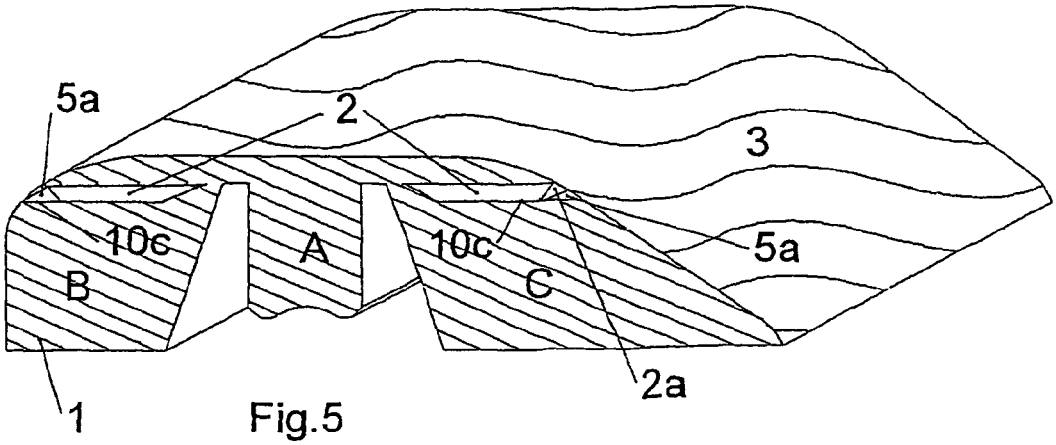
FIG. 5 shows a sectional view, in three dimensions, of the finishing set of the invention with three applications, created by means of the modular finishing profile of FIG. 1, the two reinforcement elements of FIG. 2 and the decorative film of FIG. 4.

FIG. 5 shows an example of a finishing set for a floor covering that can be configured into three different finishing functions. This finishing set comprises a single modular finishing profile 1, covered with a decorative film 3, and two removable reinforcement means 2.

Figure 1:
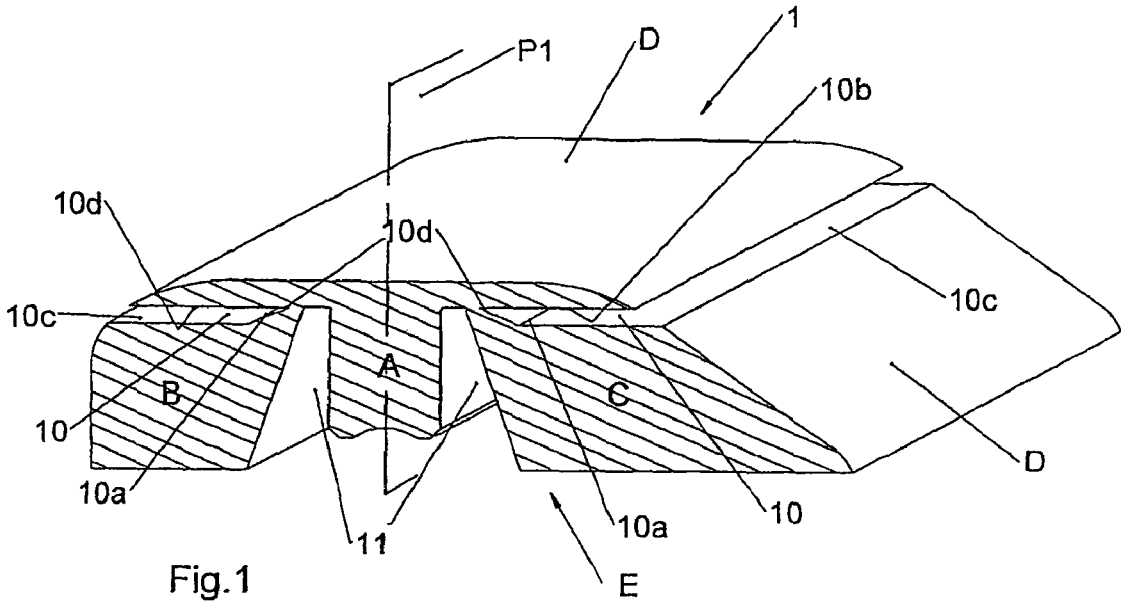
FIG. 1 shows a sectional view, in three dimensions, of the modular profile of a finishing set with three applications according to the invention.

With reference to FIG. 1, the modular profile 1 is a linear piece, manufactured for example in wood or similar, or extruded from a plastic material, in particular PVC or similar, or in metal, in particular aluminium or similar. It displays a first surface D forming the visible surface of the profile 1 and a second surface E forming the base of the modular finishing profile 1.

The profile 1 includes, on its surface D, two lateral separation grooves 10, which extend over the entire length of the profile 1. In the particular illustrated example, these grooves are horizontal with identical cross sections, and symmetrical to one another with reference to the central longitudinal plane P1 of the profile 1. On the annexed drawings, the base of each groove 10 is referenced with 10*a*, and the two lateral, essentially parallel, walls of each groove 10 are referenced with 10*b* and 10*c*, respectively.

Figure 8:
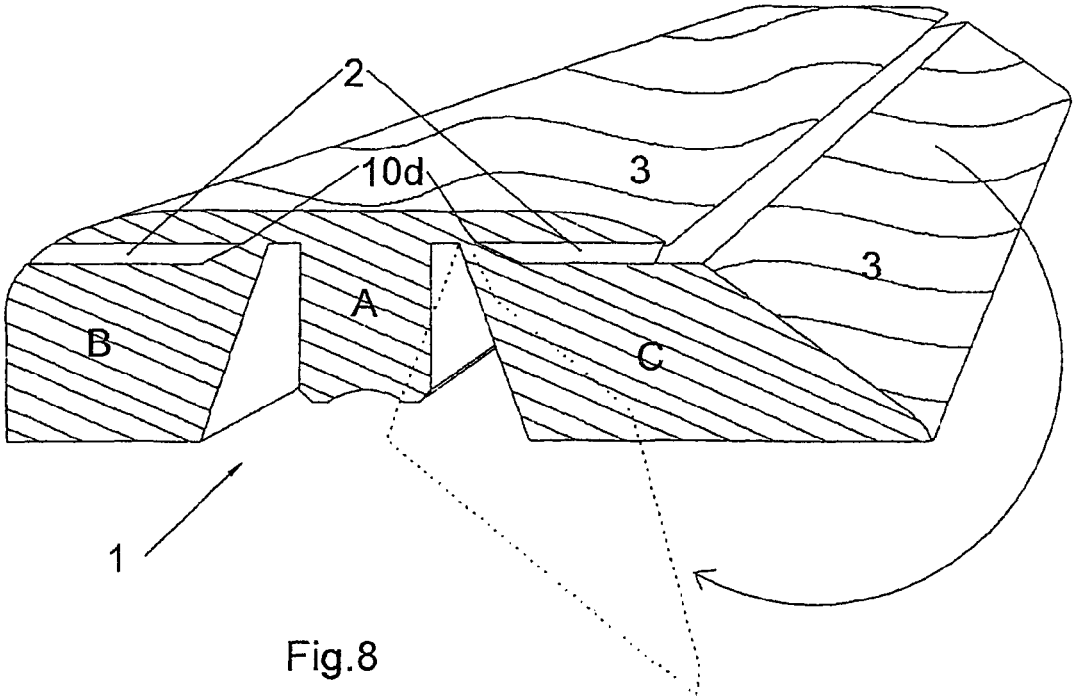

More particularly, the base 10*a* of each groove 10 is inclined with regard to the lateral walls 10*b*, 10*c*, so as to form at the junction with the upper lateral wall 10*b* a rupture line 10*d* (FIGS. 1 and 8).

The modular finishing profile 1 includes on its surface E two grooves 11 perpendicularly orientated to the separation grooves 10, i.e. vertically on the drawings. These vertical grooves 11 are identical and symmetrical to one another with reference to the central vertical longitudinal plane P1 of the profile 1.

The horizontal separation grooves 10 and the vertical grooves 11 define three separable modules (A), (B) and (C) in the profile 1.

Figure 10:
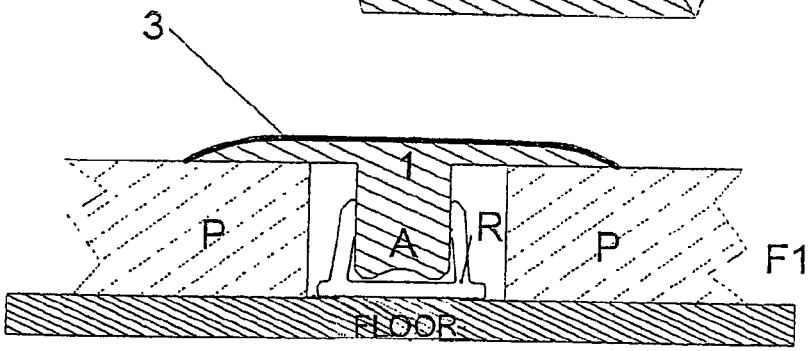
FIGS. 10, 11 and 12 show respectively the sectional views of a finishing set of FIG. 5, implemented in each case in its three different finishing functions.

The T-shaped module A in the centre fulfils the function (F1) of a junction between two coverings, as illustrated in FIG. 10.

The central T-shaped module A also serves as the basis for the two other finishing functions (F2) and (F3). The two associated modules (A) and (B) are used for the finishing function (F2), illustrated in FIG. 11. The two associated modules (A) and (C) are used for the finishing function (F3), illustrated in FIG. 12.

Figure 2:
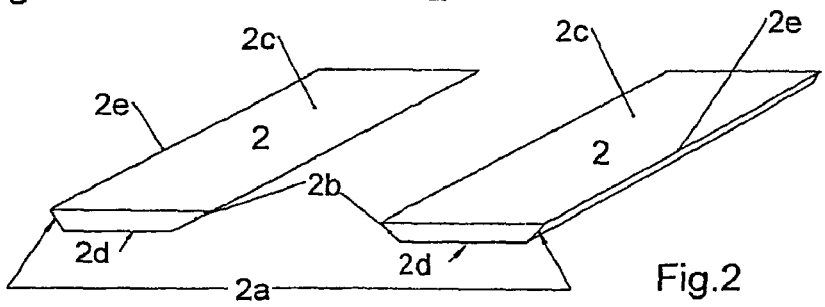
FIG. 2 shows a sectional view, in three dimensions, of the two reinforcement elements of the finishing set with three applications according to the invention.

With reference to FIG. 2, the reinforcement elements 2 of the finishing set are two thin, linear identical wedges manufactured either out of wood or similar, or extruded in aluminium, PVC or similar.

In the particular example of FIG. 2, each reinforcement wedge 2 displays a cross section of a trapezoid shape. The four surfaces of each wedge 2 are referenced with 2*a*, 2*b*, 2*c* and 2*d*, respectively. The surface 2*a*, called the external surface, corresponds to the surface of the wedge 2 intended to be oriented towards the exterior of the separation groove 10, once the wedge is positioned in said groove 10; the other surfaces 2*b*, 2*c* and 2*d* are called the internal surfaces and are intended to be oriented towards the base 10*a* and the two lateral walls 10*b* and 10*c* of the separation groove 10, respectively, once the wedge is positioned in said groove 10.

More particularly, the external surface 2*a* includes a longitudinal front ridge 2*e*, which enables the contact surface of the wedge with the decorative film 3 to be restricted, thus preventing the wedge 2 from adhering to the decorative film 3. This ridge 2*e* also enables a cutting space 5*a* (FIG. 5) to be created in the separation groove 10 (FIG. 5) for introducing the blade of the specific cutting tool 4 of FIG. 6.

In the particular example of the geometry of the wedge 2 of FIG. 2, the longitudinal front ridge 2*e* is formed by the junction between the internal upper surface 2*c* and the external surface 2*a* of the wedge. This does not limit the invention. In another embodiment, the longitudinal front ridge 2*e* can be formed by the junction between the lower surface 2*d* and the external surface 2*a* of the wedge, or the wedge could include an uneven external surface 2*a* including said longitudinal front ridge 2*e*.

Figure 3:
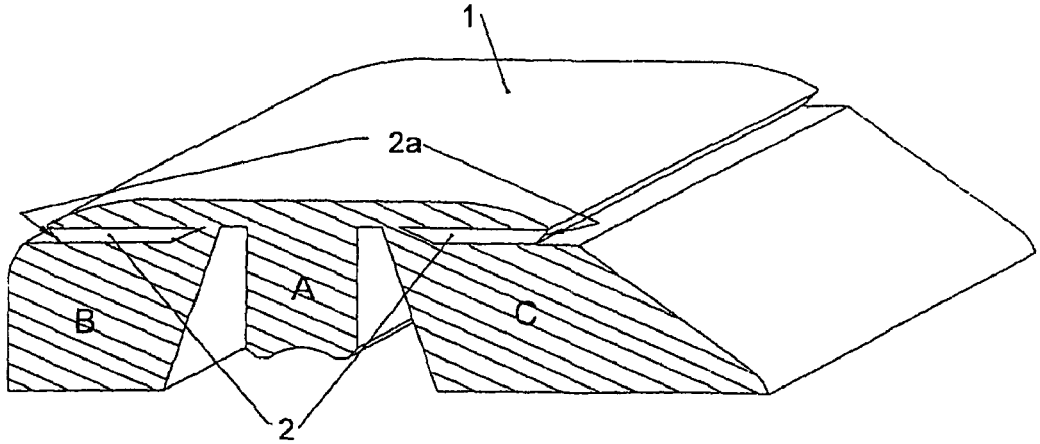
FIG. 3 shows a sectional view, in three dimensions, of the modular finishing profile of FIG. 1 integrating the two removable reinforcement elements of FIG. 2.

With reference to FIG. 3, the two reinforcement wedges 2 are inserted respectively into the two separation grooves 10 of the modular profile 1. They enable the two separation grooves 10 of the profile 1 to be filled and to prevent the single profile 1 from being broken during the implementation of the finishing function (F2) of FIG. 11 or the finishing function (F3) of FIG. 12.

More particularly, each reinforcement wedge 2 displays a geometry complementary to the geometry of a separation groove 10 serving as its housing, and is positioned in the separation groove so as to be in contact with the two lateral walls 10*b*, 10*c* and the base 10*a* of the separation groove, preferably over the entire surface of its three internal surfaces 2*b*, 2*c*, 2*d*.

Figure 4:
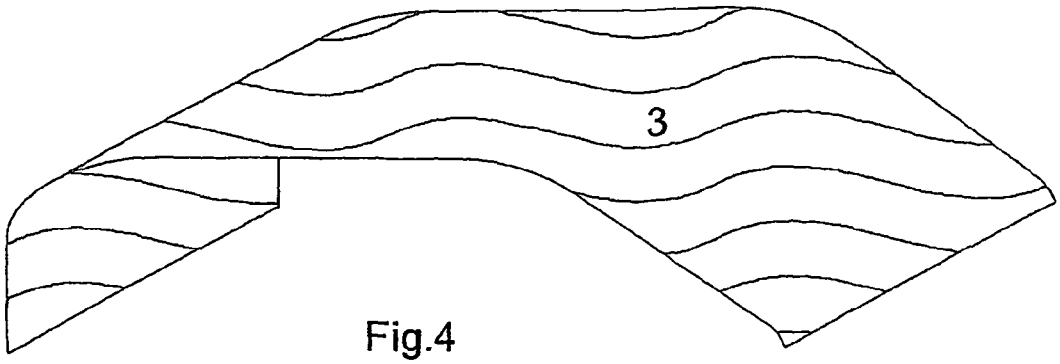
FIG. 4 shows a sectional view, in three dimensions, of the decorative film of the finishing set with three applications.

With reference to FIG. 4, the decorative film 3 is a decorative cover, for instance out of paper, melamine or wood veneer. This decorative film 3 can be of a single layer or multi-layered. The decorative film 3 serves as a decorative element for the finishing profile 1 of FIG. 1 in such a manner that the finishing profile for instance matches the finish of the floor covering.

The decorative film 3 is applied on the visible surface D of the profile 1, and is fastened to this surface, for instance through gluing. This film 3 covers the two separation grooves 10 and thus enables the two separation grooves 10 of the modular profile 1 to be closed, and prevents the two reinforcement wedges 2 from exiting the separation grooves 10. This film 3 also contributes to the reinforcement of the modular finishing profile 1.

With reference to FIG. 5, the finishing set with three applications is shown completely assembled and ready for use. The decorative film 3 glued onto the profile 1 defines, with the external surface 2*a* of each wedge 2 and the lower lateral wall 10*c* of each separation groove 10, a longitudinal cutting space 5*a* extending over the entire length of the finishing profile 1. These cutting spaces 5*a* are used for the cutting of the decorative film 3 along each separation groove 10, during the implementation of the finishing device.

Figure 6:
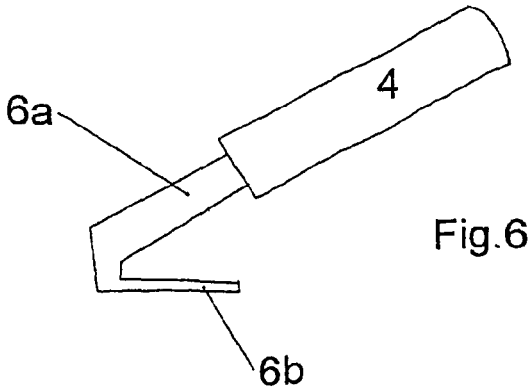
FIG. 6 shows a cutting tool that can be used to cut the decorative film of the finishing set of FIG. 5, FIGS. 7 to 9 show the three main stages for the configuration of the finishing set of FIG. 5 in one of its three finishing functions.

With reference to FIG. 6, the specific cutting tool 4 includes on its cutting blade 6*a* a guiding arm 6*b*, which serves as a guide and which is intended to penetrate into the cutting space 5*a* of the finishing set with three functions of FIG. 5.

Figure 7:
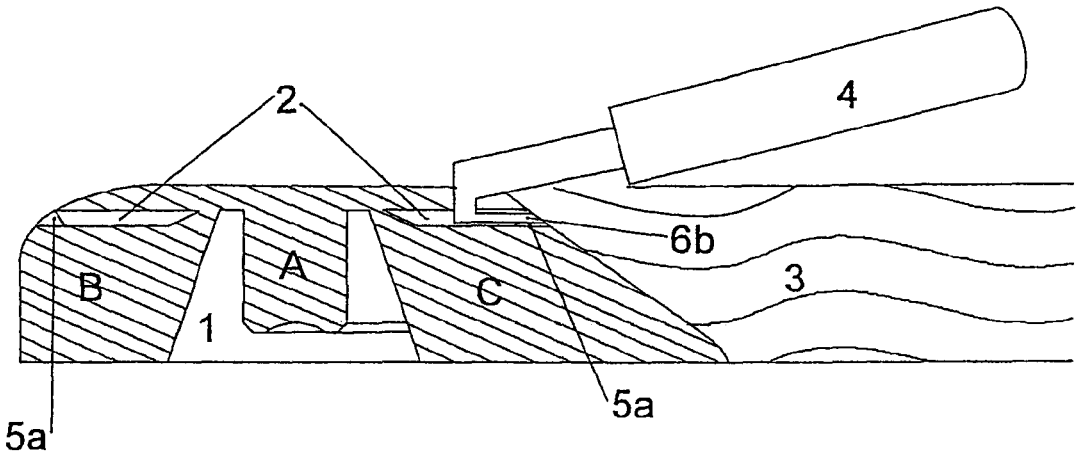

FIG. 7 shows a view in three dimensions of the first step of the implementation of the finishing device with three functions. This first step consists in cutting the decorative film 3 with the help of the specific tool 4. In order to obtain the desired function, the decorative film 3 must firstly be cut along a separation groove 10, so as to be able to release the unnecessary module(s) (B) and/or (C). In order to do this, the guiding arm 6*b* is introduced into the cutting space 5*a* of the separation groove 10 corresponding to the module (B) or (C) that one wishes to separate from the central module (A). Then the cutting tool is made to slide along the groove 10, so that the decorative film 3 is cut along its entire length.

With reference to FIG. 8, in a second stage, after having released the module (B) and/or (C) by cutting the decorative film 3, the module (B) and/or (C) is pushed downwards so that the rupture line 10*d* plays its role and enables the module (B) and/or (C) to be broken along this rupture line 10*d*. It is up to the person skilled in the art to judiciously adapt the depth of the separation groove 10 and the geometry of the base 10*a* of a separation groove 10 so that the finishing profile 1 can be easily divided manually, after the cutting of the decorative film 3 along the separation groove.

Figure 9:
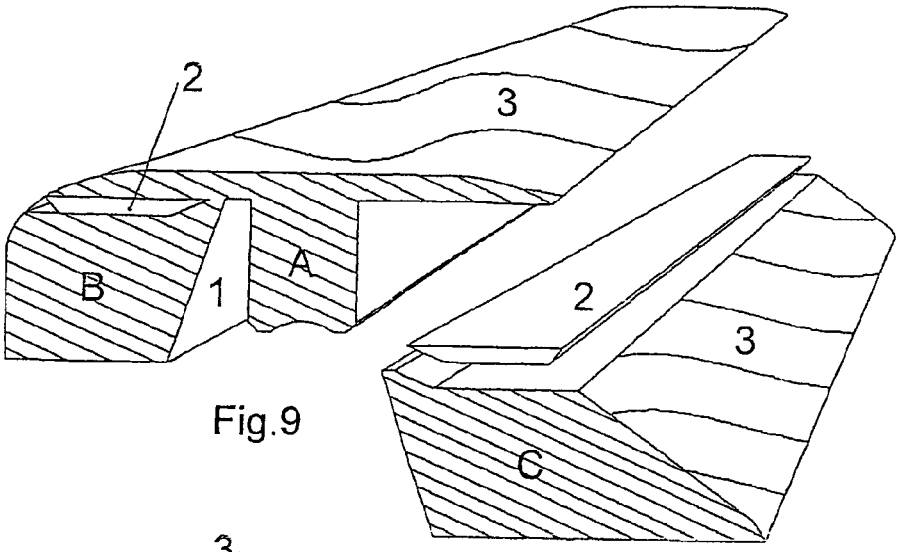
Figure 11:
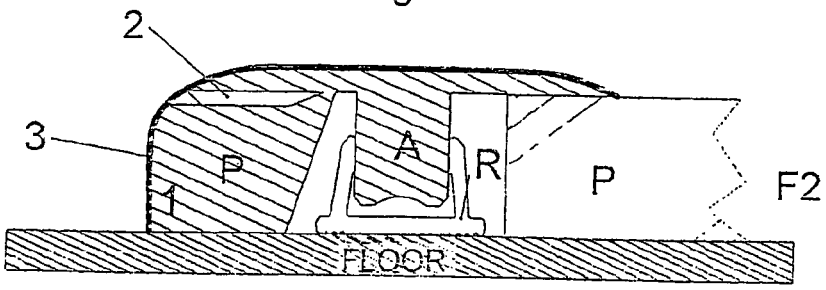

FIG. 9 shows the finishing set after the separation of the module (C), with a view to using this finishing set to fulfil the finishing function (F2) of FIG. 11. Having separated the module (C) of the central module (A), the corresponding removable reinforcement wedge 2 is also withdrawn, as it is no longer integral with the profile 1.

FIG. 10 shows the finishing function (F1) of the finishing set. Only the module (A) is retained so as to obtain the function (F1) of a junction between two floor coverings (P) laid on the floor (SOL). The base of the module (A) serves as a securing foot by being encased in the support and tightening rail R, which is fastened beforehand to the floor (SOL) with the help of a screw, or with glue, between the two floor coverings P. Because of this, the finishing set is advantageously removable.

FIG. 11 shows the finishing function (F2) of the finishing set. The association of the module (A) and the module (B) enables the end fastening function (F2) to be obtained at the edge of a floor covering P laid on the floor (SOL). The base of the module (A) serves as a securing foot by being encased in the support and tightening rail R, which is fastened beforehand to the floor with the help of a screw, or with glue, next to the floor covering P.

Figure 12:
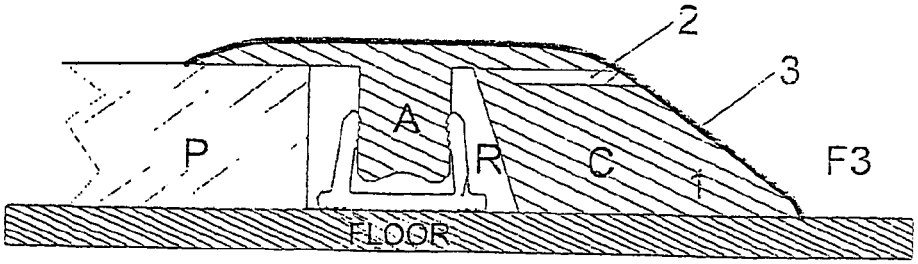

FIG. 12 shows the finishing function (F3) of the finishing set. The association of the module (A) and the module (C) enables the function (F3) of level adjustment to be obtained between a floor covering (P) laid on the floor (SOL) and the level of the floor or the level of another floor covering of an inferior thickness.

Figure 13:
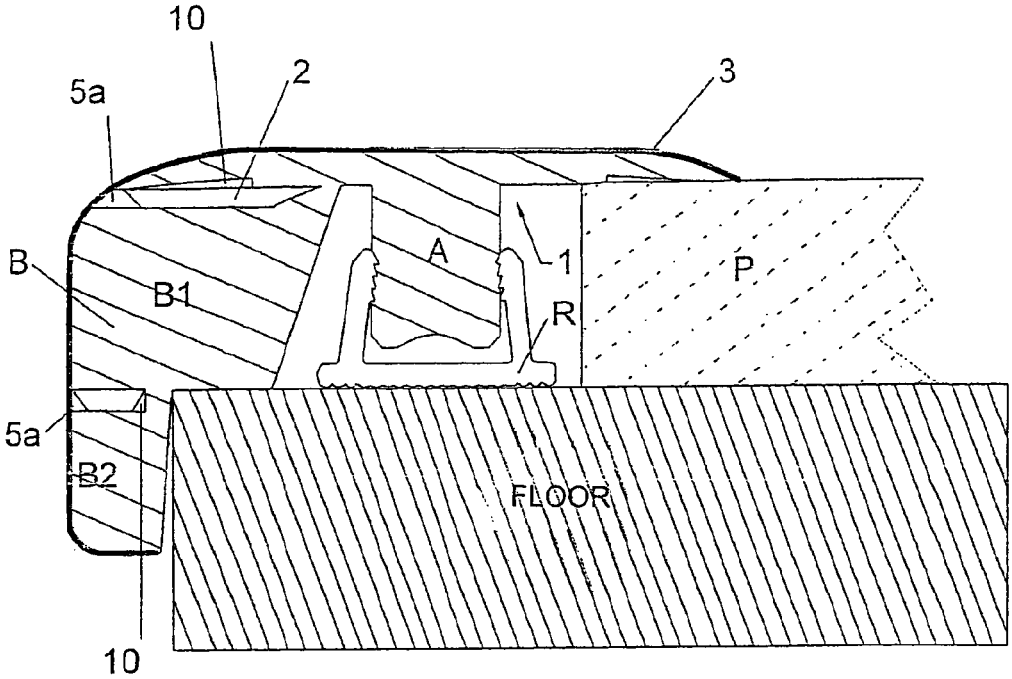
FIGS. 13 and 14 show respectively, in cross section and in perspective, an implementation example of a further embodiment of a multifunction finishing set according to the invention.
Figure 14:
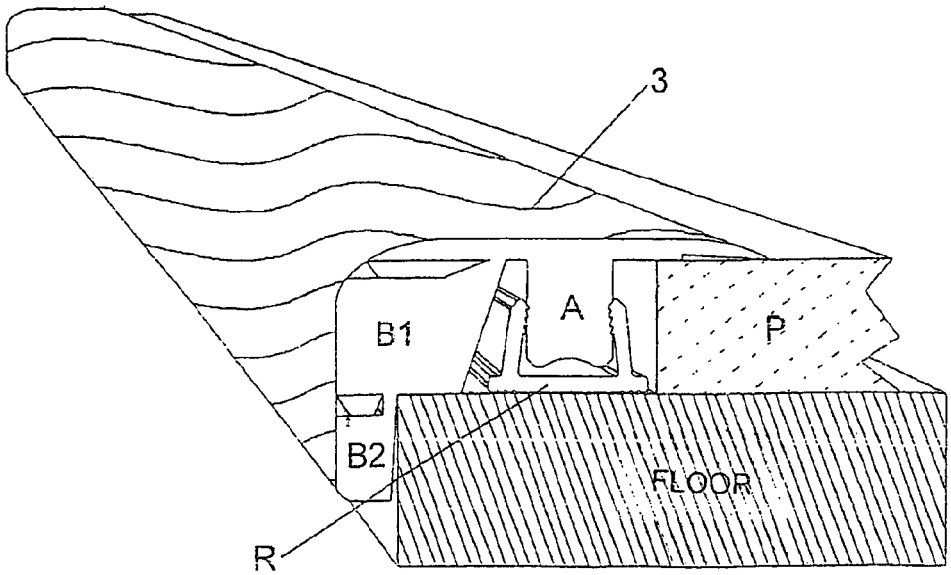

FIGS. 13 and 14 show another embodiment of a multifunction finishing set of the invention, which is configured and implemented in a function (F'2) of end fastening at the edge of a floor covering (P) laid on the floor (SOL). This finishing set differs from the finishing set of FIG. 5 owing to the implementation of a module B, which is itself separable into two modules B1 and B2, in order to adapt the height and the profile of the module B with regard to the profile of the floor. In FIGS. 13 and 14, the module C is not represented since it has been withdrawn for the implementation of the end fastening function (F'2).

The two modules B1 and C1 are separated by a separation groove 10, covered by the decorative film 3 and reinforced by a reinforcement wedge 2. The module B2 can be separated from the module B1, after the cutting of the decorative film 3 along the separation groove 10 between the modules B1 and B2, in view of using the finishing set to fulfil another end fastening function (F2), similar to that of FIG. 11.

The invention is not limited to the realisation of a multifunction set including three separable modules (A), (B) and (C), or four separable modules (A), (B), (B1), (C), but can be generalised to realise any multifunction finishing set including at least two separable modules, on which a same decorative surface covering is applied. For instance, a finishing set with two applications including just one T-shaped module (A) and a module (B) or a module (C), or a multifunction finishing set including more than four separable modules can be realised.

In addition, the cross-section profiles of the separable modules (A), (B), (C), (B1), (B2) of the annexed drawings have been given merely as non-exhaustive examples of embodiments, the invention not being limited to only these profile forms.

The invention claimed is:

1. A finishing set with at least two different applications comprising a modular profile in which is created at least one separation groove for separating the profile into two distinct modules, and a decorative film, which is applied to the profile and which covers the separation groove, wherein said set also includes a removable reinforcement means, which allows a reinforcement of the modular profile at the level of the separation groove, the finishing set having a cross section in which the reinforcement means is completely surrounded by a plurality of internal surfaces of the separation groove and the decorative film, the decorative film blocking removal of the reinforcement means from the separation groove.

2. The finishing set according to claim 1 with at least three different applications, wherein the at least one separation groove includes two separation grooves each having three internal surfaces, the decorative film, which is applied on the modular profile covers the two separation grooves, and wherein the removable reinforcement means consists of two reinforcing elements each housed in and contacting an entirety of the three internal surfaces of one of the two separation grooves.

3. The finishing set according to claim 1 wherein the modular profile can be separated into at least two distinct modules, one module of which is adapted to fulfill a function of a junction between two floor coverings.

4. The finishing set according to claim 3, wherein the modular profile, prior to separation into several modules, is adapted to fulfill a function of end fastening or a function of level adjustment between a floor covering and the floor or another floor covering of a different thickness.

5. The finishing set according to claim 2, wherein the modular profile can be separated into at least three modules, that a first module, once separated from the other modules, is adapted to fulfill a function of a junction between two floor coverings, that said first module and a second module integral with the first module are adapted to fulfill a function of end fastening between a floor covering and the floor or another floor covering of a different thickness, that said first module and a third module integral with the first module are adapted to fulfill a function of level adjustment between a floor covering and the floor or another floor covering of a different thickness.

6. The finishing set according to claim 1, wherein the modular profile can be separated into at least two modules, including a T-shaped module.

7. The finishing set according to claim 1, wherein the modular profile can be separated into at least three modules: a central T-shaped module, and two lateral modules on either side of a foot of the central T-shaped module.

8. The finishing set according to claim 1, wherein the separation groove is adapted so as to make the modular profile manually divisible into two distinct modules, after cutting of the decorative film along the separation groove.

9. A finishing set with at least two different applications comprising a modular profile in which is created at least one separation groove for separating the profile into two distinct modules, and a decorative film, which is applied to the profile and which covers the separation groove wherein said set also includes a removable reinforcement means, which is housed in a space delimited by the separation groove and by the film and which allows a reinforcement of the modular profile at the level of the separation groove, wherein the reinforcement means includes a longitudinal ridge at the level of its external surface facing the decorative film and is in contact with the film by means of this ridge in order to limit the contact surface of said means with the film and to arrange a longitudinal space in the separation groove for cutting of the film.

10. The finishing set according to claim 1, wherein each reinforcement means displays a geometry complementary to the geometry of the separation groove that serves as its housing, and is positioned in the separation groove such that it is in contact with two lateral walls and a base of the separation groove.

11. The finishing set according to claim 1, wherein a reinforcement means displays a transversal section of a trapezoid shape.

12. The finishing set according to claim 1, wherein each reinforcement means is made up of a thin linear wedge.

13. The finishing set according to claim 1, wherein the finishing set is a junction between two floor coverings, or an end fastening or a level adjustment between a floor covering and the floor or another floor covering of a different thickness.

14. A finishing set comprising:

a single-piece modular profile defining at least one horizontal separation groove, the at least one separation groove defined by a base wall, a first lateral wall and a second lateral wall, the groove for initiating separation of the profile into two distinct modules about a rupture line in the base wall;

a decorative film applied to the single-piece profile and which covers the separation groove; and a removable reinforcement piece located in the separation groove having a geometry complementary to a geometry of the separation groove and thereby substantially filling the separation groove from the base wall to the decorative film that provides reinforcement of the single-piece modular profile at the level of the separation groove.

15. The finishing set of claim 14, wherein the base wall of the separation groove is not perpendicular to the first lateral wall and the second lateral wall.

16. The finishing set of claim 14, wherein the removable piece is trapezoidal shaped, and when installed in the separation groove, contacts the base wall, the first lateral wall and the second lateral wall.

17. A finishing set comprising:

a one-piece modular profile defining first and second horizontal, aligned separation grooves each defined by a base wall, an upper first lateral wall and a lower second lateral wall, the base wall of each groove inclined with regard to the first and second lateral walls so as to form at a junction with the upper first lateral wall an initiation point of a rupture line into the modular profile for separating the profile into two distinct modules; and a physically separate removable reinforcement piece in each of the separation grooves having a geometry complementary to a geometry of the separation grooves and thereby entirely filling the separation grooves and which allows a reinforcement of the modular profile within the separation grooves.

18. The finishing set of claim 17, wherein the separation groove is trapezoidal shaped, and the physically separate removable reinforcement piece is trapezoidal shaped and contacts the base wall, the first lateral wall and the second lateral wall when installed in the separation groove.

19. The finishing set of claim 18, further comprising:

a decorative film separately applicable to the profile and which covers the separation groove.

20. The finishing set of claim 19, wherein the removable reinforcement piece includes an external surface including a longitudinal front ridge restricting a contact surface between the removable reinforcement piece and the decorative film, thereby preventing the removable reinforcement piece from adhering to the decorative film.

21. The finishing set of claim 14, wherein the removable reinforcement piece includes an external surface including a longitudinal front ridge restricting a contact surface of the removable reinforcement piece located at the decorative film, thereby preventing the removable reinforcement piece from adhering to the decorative film.

* * * * *